United States Patent [19]

Stutt et al.

[11] 4,018,144

[45] Apr. 19, 1977

[54] FLAP FOLDING MECHANISM FOR CARTON MAKING MACHINES

[75] Inventors: Colin Stutt, Bristol; Anthony John Noble, Skipton; Reginald Arthur Ford, Bristol, all of England

[73] Assignee: Masson Scott Thrissell Engineering Limited, Bristol, England

[22] Filed: July 25, 1975

[21] Appl. No.: 599,252

[30] Foreign Application Priority Data

Aug. 2, 1974 United Kingdom ..... 34123/74

[52] U.S. Cl. ..... 93/52; 93/49 R

[51] Int. Cl.[2] ..... B31B 1/52

[58] Field of Search ..... 93/49 R, 52, 48, 53 R, 93/53 SD; 53/376, 377, 381 R

[56] References Cited

UNITED STATES PATENTS

| | | | |
|---|---|---|---|
| 1,298,586 | 3/1919 | Sidebotham | 93/52 |
| 1,868,572 | 7/1932 | Hall | 93/52 |
| 2,911,889 | 11/1959 | Welsh | 93/52 X |
| 3,405,611 | 10/1968 | Millich | 93/52 UX |

*Primary Examiner*—James F. Coan
*Attorney, Agent, or Firm*—Seidel, Gonda & Goldhammer

[57] ABSTRACT

This invention relates to a carton making machine in which carton blanks having a leading flap attached to a body portion, the line on which the flap is to be folded being at right angles to the direction of movement of the blanks, are fed continuously along a feed path. The leading flap is folded by a hooked finger, which can swing on a fixed pivot, as the blank is fed over a section of the feed path having a convex configuration in the direction of travel.

The blanks are fed between cooperating upper and lower bands, but no upper band is provided over the convex section of the feed path so that the leading flap is free to extend in a direction tangential to the curve of the convex section. With such a construction it is possible to feed the blanks in an overlapped formation and still be able to fold the leading flap as a gap will be formed between the underside of the flap and the top surface of the preceding blank, thus allowing the finger to engage the leading edge of the flap.

In a preferred form the convex section of the feed path is formed by part of the peripheral surface of a suction feed wheel which removes blanks one at a time from a stack of blanks formed in a magazine.

12 Claims, 13 Drawing Figures

FLAP FOLDING MECHANISM FOR CARTON MAKING MACHINES

This invention concerns improvements in or relating to carton making machines and more particularly to apparatus, forming part of such machines, for folding flaps of carton blanks.

In machines for making cartons it is often desirable to fold all the flaps of a carton blank whilst the blank is being conveyed along a single straight path, the path being flat along its whole length. In one known form of machine the leading flaps, considered in the direction of movement of the blank, are folded about the crease lines, along which they are attached to a body portion of the blank, by means of a finger, positioned adjacent the straight path and having a hooked end which is so positioned that the hooked end engages the leading end of the leading flap. As the blank continues to move it produces a swinging movement of the finger, the combined movements causing the leading edge of the leading flap to be lifted, thus folding the leading flap about the crease line.

According to the present invention there is provided a carton making machine including means for conveying a succession of carton blanks along a feed path, each blank comprising a body portion and a flap connected to said body portion at the leading end thereof, as considered in the direction of movement, along a crease line at right angles to said direction and folding means to fold said flap about said crease line, wherein said feed path is of convex configuration, in the direction of movement of said blanks, along a section of its length and said folding means is positioned adjacent said convex section of said feed path so that said flap is folded by said folding means as said carton blank is fed along said convex section of said feed path by said conveying means.

Conveniently said conveyor means comprises a plurality of pairs of conveyor bands arranged side by side across the width of the machine, the bands of each pair being positioned one above the other so that said blanks are gripped between cooperating runs of each pair of bands, and means for diverting said cooperating runs of each of said plurality of pairs of conveyor bands out of the plane of said feed path to form said convex section of said feed path. There will, of course, be at least one lower band having no upper band positioned thereabove in order that said flap may be folded about said crease line by said folding means. In a preferred form of apparatus however, an upper band may be provided above said one lower band both upstream and downstream of said convex section of said feed path.

In a preferred form said diverting means may comprise a guide member consisting of a plurality of rotatable drums which are so positioned that the said one lower conveyor band and the cooperating runs of each of said pairs of conveyor bands pass round an arc of the peripheral surface of a different one of said drums. Alternatively said guide member may consist of a plurality of fixed blocks each having a convex surface over which the cooperating runs of one of said pairs of conveyor bands passes.

Machines in which all the flaps of a carton blank are folded whilst the blank is conveyed along a single flat path, are usually of considerable overall length, so any reduction in length is advantageous, especially where floor space is at a premium.

This may be readily achieved in a machine according to the present invention by further including in said machine a magazine in which carton blanks are stacked substantially horizontally with each blank supported on one of its edges thereof, wherein said magazine includes feed means for said blanks consisting of at least one rotatable wheel, means to apply suction thereto, and at least one rotatable support member, and means to drive said feed means so that the blanks are removed in succession one at a time from said magazine, wherein a portion of the peripheral surface of said rotatable wheel together with a portion of the peripheral surface of said support member constitutes said convex section of said feed path. It will be seen that with such an arrangement the folding means may be positioned adjacent the feed means to operate on blanks traversing the convex section of the feed path and there is then no need for the feed path to have a straight section of any substantial length.

Carton blanks in known forms of machine are usually fed through the machine at spaced intervals, in which case the hooked end of the finger, mentioned previously, is able to drop below the plane of the blank through the gap between successive blanks, so as to be in position to engage the leading edge of the leading flap of the next succeeding blank. Under these conditions any increase in machine output can only be obtained by increasing the rate at which carton blanks are fed into the machine, and also the speed of the conveying means carrying the blanks through the machine. With a machine according to the present invention however, the output of the machine may be increased by only increasing the rate at which said feed means feeds blanks into the machine per unit of time, the speed of the conveying means being unaltered.

Under these conditions the carton blanks are fed along said feed path in an overlapped formation (i.e. the leading portion of each blank overlies the trailing portion of the preceding blanks).

Preferably when blanks are being fed, by said conveying means, in such an overlapped formation, said body of said blanks is onstrained to follow the contour of said convex section of said feed path, said flap being free to extend tangentially to said convex section of said feed path so that a gap is formed, between the bottom face of said flap and the top face of the body portion of the next preceding blank, so the leading edge of said flap is readily accessible to the folding means (which may be a hooked finger of known form).

Depending on the desired parameters (e.g. size, complexity and material) of the carbon blank being handled, the output of a machine according to the invention in which the carton blanks are conveyed in overlapped formation would be between 30–100% higher than if the same blanks were conveyed at spaced intervals.

Preferred embodiments of a machine according to the invention will now be described by way of example only, with reference to the accompanying drawings in which.

Figure 2:
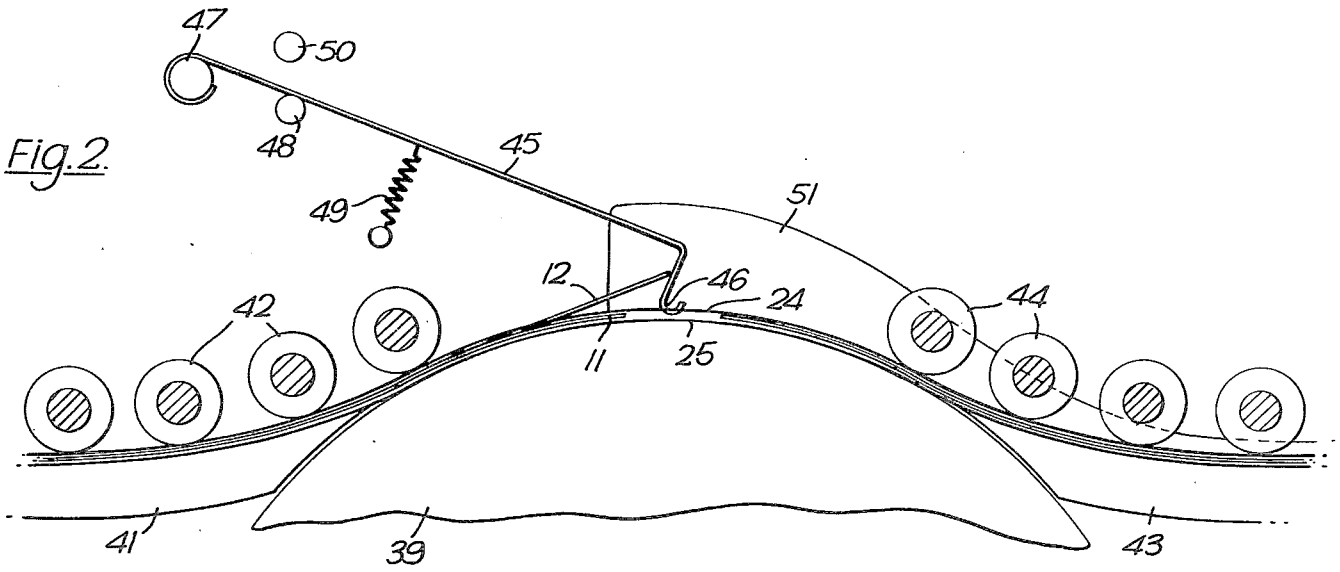
FIG. 2 is part of FIG. 1 drawn to a larger scale.
Figure 3:
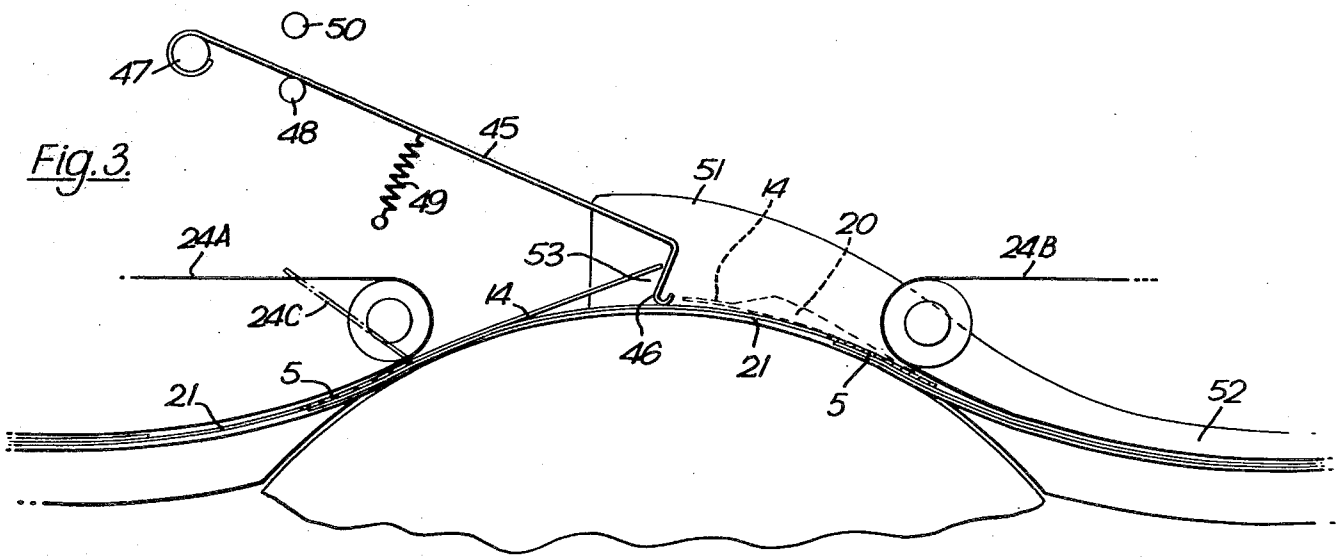
Figure 4:
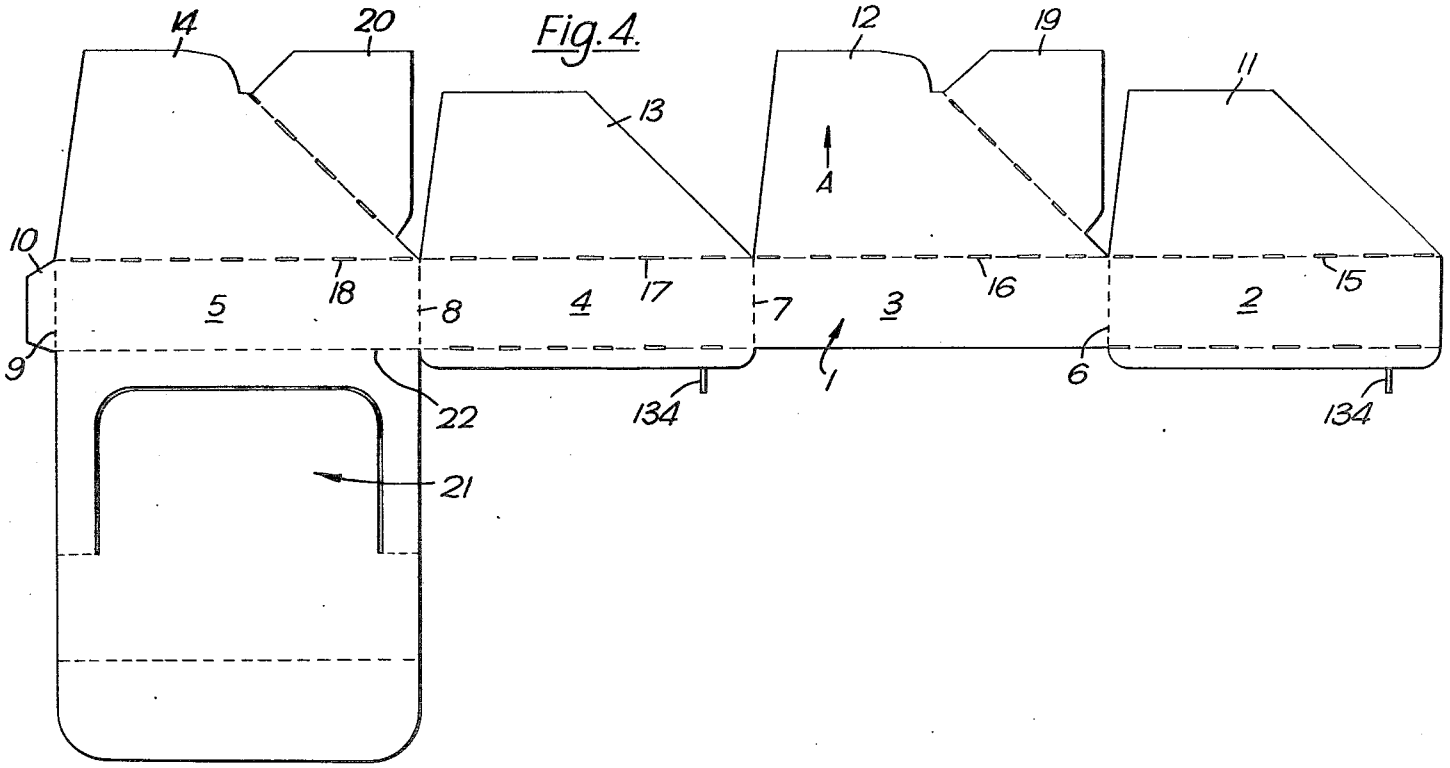
Figure 5:
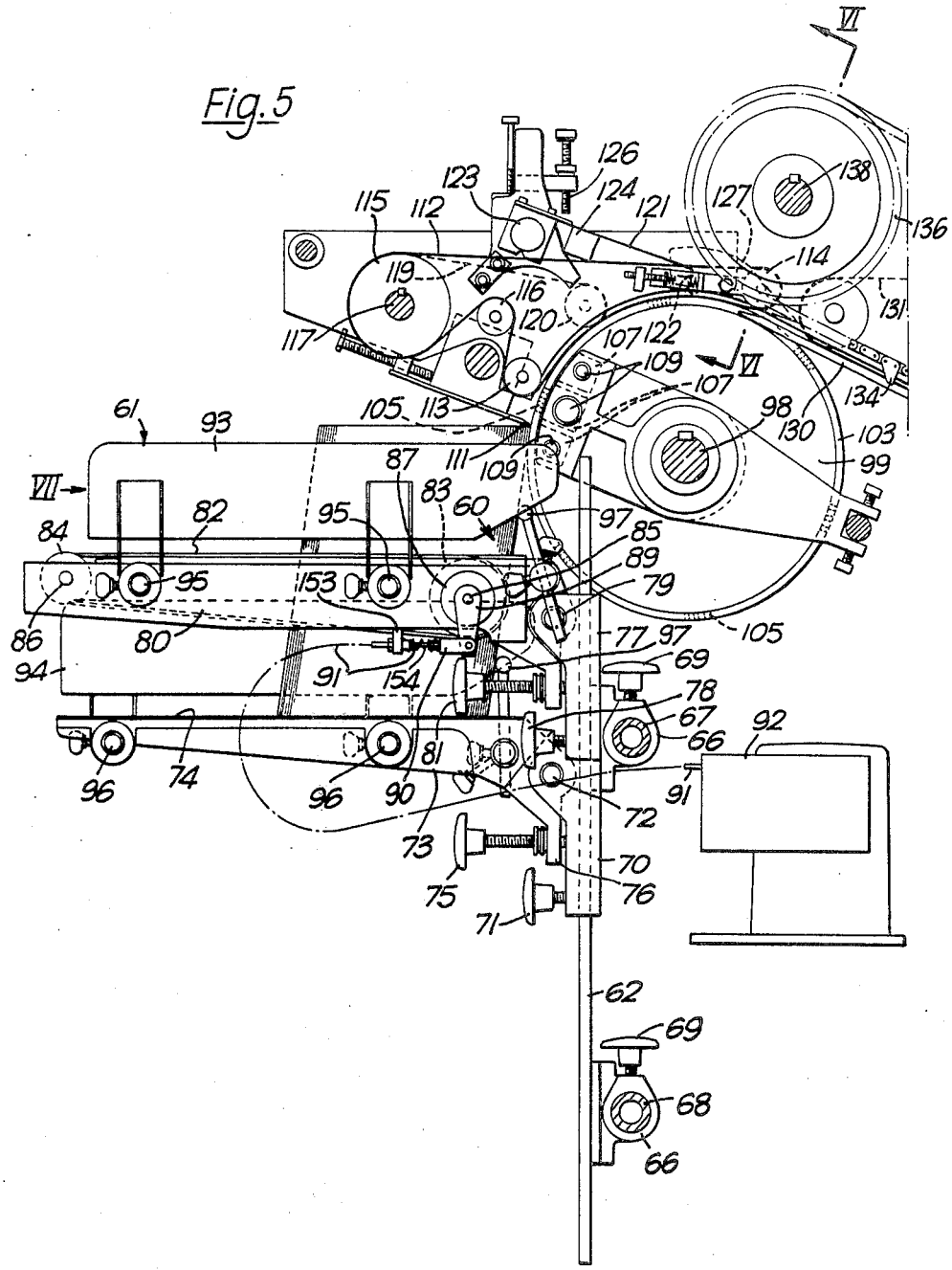
Figure 5A:
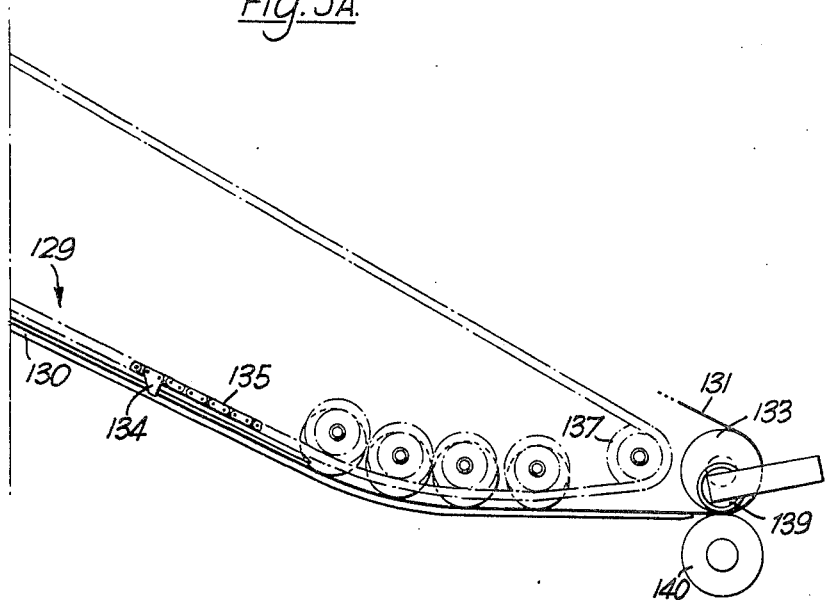
Figure 6:
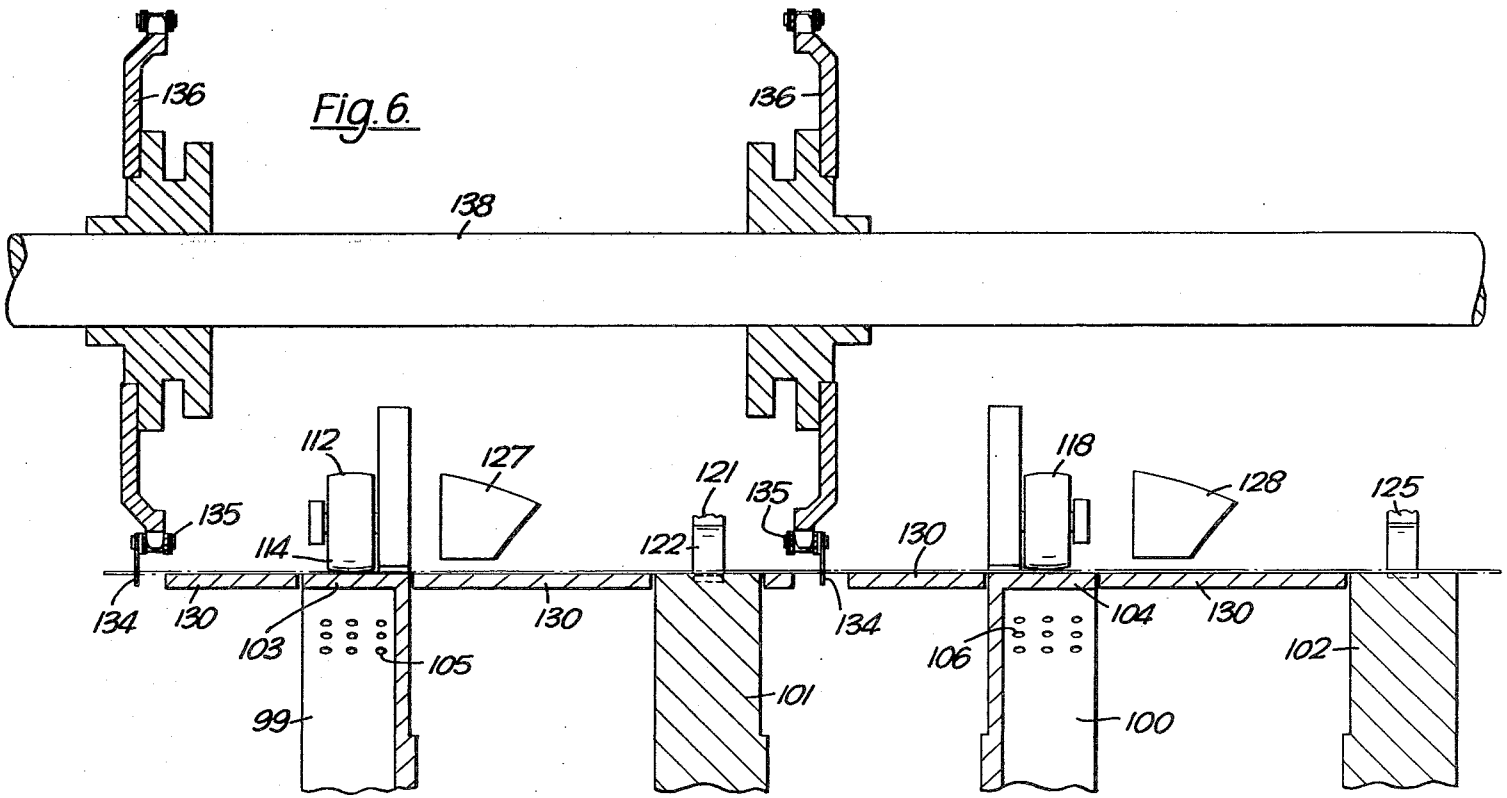
Figure 7:
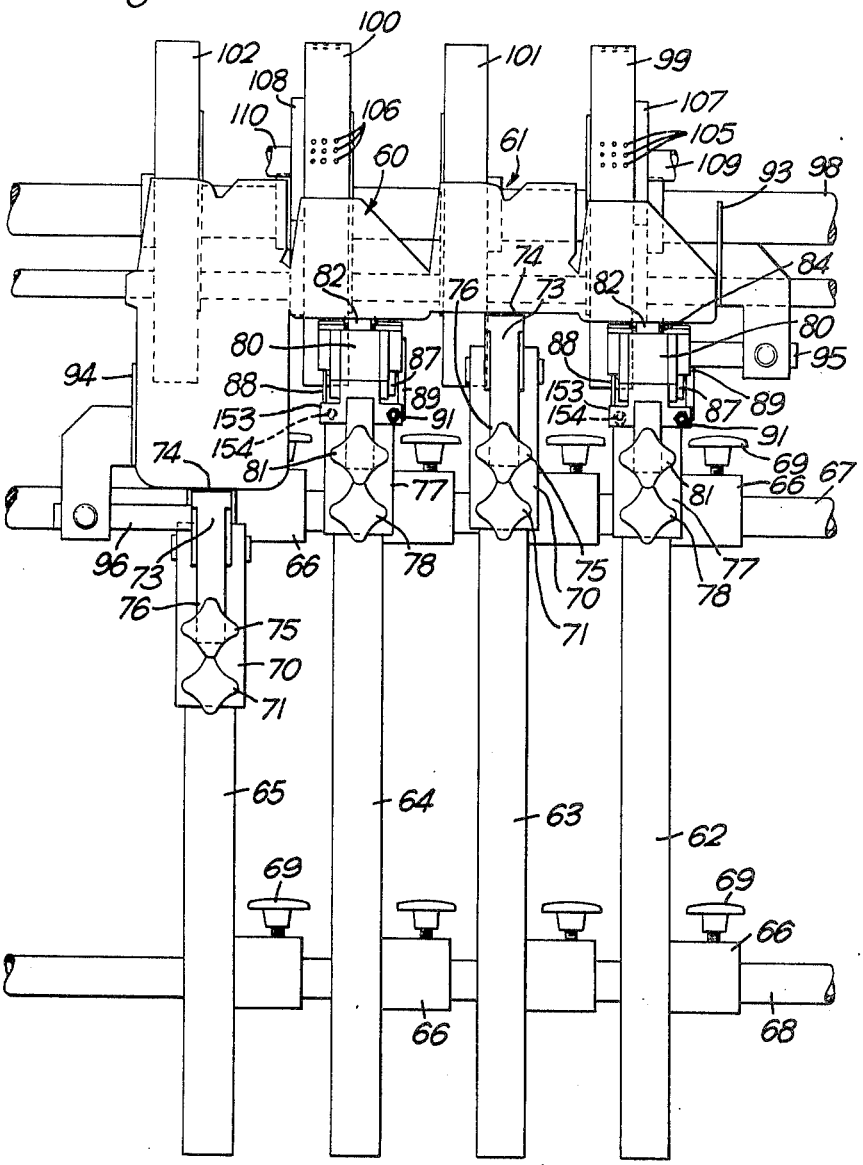

FIG. 3 is a view similar to FIG. 2 but showing the carton blanks being fed in overlapped formation, FIG. 4 is a plan of a typical carton blank used in a machine embodying the invention, FIGS. 5 and 5A when placed side by side form a side view of part of a preferred form of carton making machine embodying the invention, FIG. 6 is a section on the line VI—VI of FIG. 5, FIG. 7 is an end view of FIG. 5 taken in the direction of arrow VII, and FIG. 8A to 8E show five different ways of blanking off suction holes formed in part of the apparatus of FIG. 5.

Referring first to FIG. 4 the carton blank has a body portion 1 consisting of four panels 2, 3, 4 and 5, the blank being foldable along crease lines 6, 7, 8 and 9 and a tab 10 is attached to the panel 5 along crease line 9. Attached to the top, in the drawing, of the body portion 1 are flaps 11, 12, 13 and 14, defined by crease lines 15. 16, 17 and 18 respectively. It will also be seen that portions of the flaps 12, 14, have creases between them and the remainder of their respective flaps so that said portions constitute tabs 19, 20. Attached to the bottom, in the drawing, of the body portion 1, is a flap 21 defined by crease line 22.

The blank moves through the machine as will be described later, in the direction indicated by the arrow A in FIG. 4, so for convenience the flaps 11 to 14 will be referred to as leading flaps.

Figure 1:
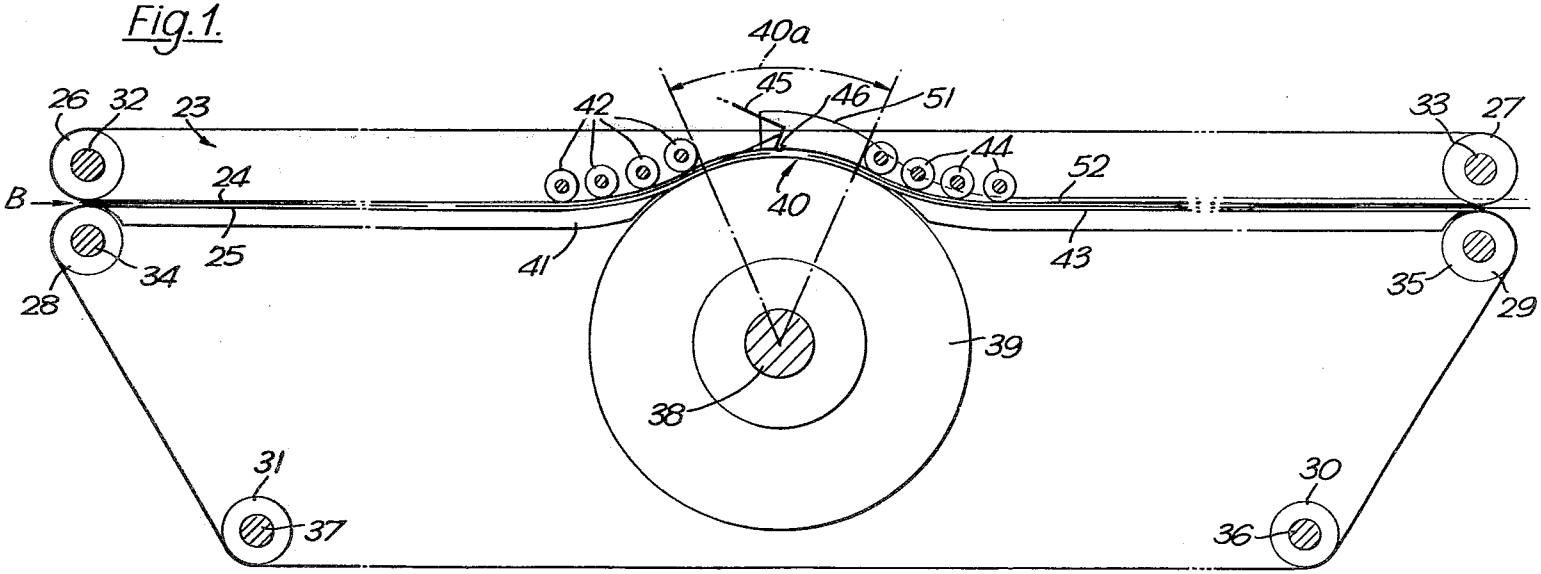
FIG. 1 is a diagrammatic side view of part of a carton-making machine embodying the invention, the carton blanks being fed at spaced intervals.

Referring now additionally to FIGS. 1 and 2, blanks are fed, one at a time, from a magazine of any convenient form (not shown) in the direction of arrow B (FIG. 1) to a conveyor 23, the blanks being fed along continuously at definitely spaced intervals. As the same sequence of operations takes place on each blank as it is fed through the machine, in the following description the passage of a single blank through the part of the machine in which the folding of the leading flaps 12, 14 takes place, will be described in the case of each of the embodiments shown in the drawings.

With the particular size of blank illustrated the conveyor 23 comprises two pairs of endless bands, each pair consisting of an upper band 24 and a lower band 25, only one pair being visible in FIG. 1, and two further lower bands 25 (not visible in FIG. 1). The bands 24 extend between rollers 26, 27 and the bands 25 extend round rollers 28 to 31, the rollers 26, 27 being fixed on shafts 32, 33 respectively and the rollers 28 to 31 being fixed on shafts 34 to 37 respectively. The shafts 33, 35 are driven continuously by any convenient means (not shown), and the various rollers and associated bands are so disposed that the blank is gripped between adjacent runs of the pairs of bands 24, 25 and supported on its underside by the further lower bands 25. More specifically, the bands are so positioned across the width (i.e. the dimension at right angles to the plane of the drawing) of the machine that the panel 2 and flap 11 are gripped between one pair of bands 24, 25, the panel 4 and flap 13 are gripped between the other pair of bands 24, 25, the panel 5 and flaps 14, 21 are supported by one of the further lower bands 25 and the panel 3 and flap 12 are supported by the remaining lower band 25. The arrangement is such that the blank is fed in the direction of arrow B by the bands 24, 25 in a straight horizontal path.

Provided between the rollers 28, 29 is a shaft 38 on which four rollers 39 are rotatably mounted, only one such roller being visible in FIG. 1. The rollers 39 are so positioned on the shaft 38 that the peripheral surface of each roller engages a different one of the lower bands 25, the arrangement being such that the adjacent runs of the bands 24, 25 are diverted upwards away from the horizontal path and then downwards towards it, so that the blank is carried over a section of the path having a convex configuration, in the direction of travel of the blank, the convex section, indicated in FIG. 1 at 40, extending over an arc of the rollers 39 indicated at 40*a*. The adjacent runs of the bands 24, 25 with the blank gripped between them are guided from the horizontal path upstream of the roller 39, on to the peripheral surface of the rollers 39 by a fixed guide 41 and cooperating spring pressed rollers 42, and from the peripheral surface of the rollers 39 back to the horizontal path, downstream of the rollers 39, by a further fixed guide 43 and further spring pressed rollers 44.

Mounted above each of the rollers 39 over which pass the lower bands 25 having no cooperating upper band 24, is a finger 45 (only one finger being visible in FIGS. 1 and 2) having a hooked end 46. The fingers 45 are freely mounted on a shaft 47 and normally rest against a fixed stop 48, being held in this position by a spring 49. The fingers 45 need not necessarily be positioned above the rollers 39, but could, if desired be offset to one side thereof.

As the blank is carried over the convex section 40 the panel 2 with flap 11, and panel 4 with flap 13, will be constrained to conform to the contour of the wheel 39 by the upper bands 24. However, since there is no upper band 24 provided over either of the leading flaps 12, 14, the latter will not be so constrained and thus be free to extend in a direction tangential to the curve of the lower bands 25, so that the leading edges of the leading flaps 12, 14 will lift relative to the leading flaps 11, 13. As the blank is moved further over the convex section 40 the leading edges of the flaps 12, 14 each engage the hooked end of one of the fingers 45 and continued movement of the blank causes the fingers 45 to be moved in an anti-clockwise direction, as viewed in FIGS. 1, 2 against the springs 49, until the fingers engage a further stop 50. The combined movement of the blank and the fingers 45 cause the leading flaps 12, 14 to be lifted so that they are folded about the crease lines 16, 18 respectively. As the flaps 12, 14 start to lift, the tabs 19, 20 each engage underneath one of a pair of plough folders 51 (only one of which is visible in the drawing) and are folded forwards (as considered in the direction of movement of the blanks) about the crease line connecting them to their respective flaps 12, 14, until the latter are at an acute angle to the panels 3, 5 respectively at which time the flaps 12, 14 pass under the hooked ends 46 of the fingers 45.

As the blank continues to be fed in the direction of arrow B the flaps 12, 14 and tabs 19, 20 are held in the folded position by fixed bars 52. The blank is then fed to further mechanism of any convenient form for folding the flaps 11, 13 along the crease lines 15, 17 respectively. One way of doing this would be to feed the blank over a further convex section, similar to the section 40, and fold the flaps 11, 13 in the same way as described above for folding the flaps 12, 14.

The blank is then fed to further apparatus for applying adhesive to the tabs 19, 20 and tab 10, and then folding the blank about the crease lines 6 and 8, so that the tab 9 is stuck to the panel 2 and flaps 13, 14 are stuck to tabs 19, 20 respectively. This further apparatus however, forms no part of the present invention so will not be described.

The apparatus described above with reference to FIGS. 1, 2, may also with advantage be used for folding the leading flaps 11 to 14 of the blank when a succession of blanks is fed in overlapped formation by the bands 24, 25. This is shown in FIG. 3 and, as the apparatus is exactly the same as that shown in FIGS. 1, 2, will not be described again. When feeding blanks of the form shown in FIG. 4 in overlapped formation, the leading flap 14 overlaps the flap 21 of the preceding blank, but there is no overlapping of other parts of the blank.

Referring now to FIG. 3, for clearness of illustration the blanks are shown in section, the line of the section being taken along the crease line 8. As each blank is fed along the convex section 40, the leading edge of the flap will lift, as described above with reference to FIGS. 1, 2, so that a gap 53 is formed between the underside of the leading flap 14 of the blank and the top of the flap 21 of the preceding blank, as shown in FIG. 3. The leading flap 14 can therefore be folded by one finger 45 and the tab 20 by one plough folder 51, as described previously, and again the leading flap 12 and tap 19 are also folded at the same time.

By feeding the blanks in an overlapped formation as shown in FIG. 3 it is possible to handle more blanks per unit of time than when the blanks are fed as shown in FIGS. 1, 2 without any increase in the speed of the bands 24, 25.

It may, in some instances, be desirable to provide upper bands to cooperate with the further lower bands 25 so as to grip the panel 5 and flaps 14, 21 and the panel 3 and flap 12. However, such upper bands must be arranged so that they do not extend over the convex section 40. This could conveniently be achieved by providing separate upper bands upstream and downstream respectively of the convex section 40, such bands being shown at 24A, 24B respectively in FIG. 3. In a modified form of apparatus, the belts 24A (FIG. 3) are replaced by fixed plates 24C positioned, as shown in chain-dot lines in FIG. 3, so that their edges lie along the crease lines 16, 18, when the leading edges of the flaps 12, 14 start to lift on engagement with the fingers 45.

Reference will now be made to FIGS. 5, 6 and 7. In the machine shown, a stack 60 of carton blanks, of the type shown in FIG. 4, is placed in a hopper 61 so that the blanks are supported at spaced positions along their bottom (as viewed in FIG. 4) edges. The hooper 61 consists of four vertical bars 62, 63, 64 and 65 which are slidably supported, by sleeves 66, on two horizontal cross bars 67, 68 fixed between the side frames (not shown) of the machine. Each of the sleeves 66, is provided with a locking screw 69, so that each of the bars 62 to 65 may be locked in any position across the machine between the side frames. The bars 63, 65 each have a carrier 70, slidably mounted thereon, which may be clamped at any desired position along its respective bar 63, 65 by means of a screw 71, and pivotably mounted, at 72, on each of the carriers 70, is a support bracket 73, having a stationary upper surface 74. The angular position of each of the brackets 73 about the pivot 72, is adjusted by means of a screw 75, which is threaded in a lug 76, forming part of the bracket 73, and the end of which bears against the adjacent carrier 70.

The bars 62, 64 each have a carrier 77, slidably mounted thereon, which are similar to the carriers 70 and each of which may be clamped at any desired position along its respective bar 62, 64 by a screw 78. Pivotably mounted at 79 on each carrier 77 is a support bracket 80, the angular position of which may be adjusted by a screw 81. The support brackets 80 are each provided with an endless belt 82, which extends between pulleys 83, 84 carried on shafts 85, 86 respectively, the pulleys 83 each having a one-way clutch 87 fixed at one end thereof. Arms 88, 89 are mounted respectively, at one end thereof, on opposite ends of the shaft 85, each of the arms 89 being coupled to one of the clutches 87. A clevis 90 extends between the other ends of the arms 88, 89. A flexible cable 91 is attached, at one end to the clevis 90, and the other end to a motor 92, of any known convenient form, which imparts a lengthwise pull to the cable 91. Carried between the clevis 90 and a lug 153 fixed to the support bracket 80 is a compression spring 154. The pull of the cable 91 causes the arms 88, 89 to swing about the axis of the shaft 85 and the belts 82 to be driven in a clockwise direction (as viewed in FIG. 5) through the clutches 87. During each such clockwise movement of the arms 88, 89 the spring 154 is compressed and when the motor stops pulling the cable 91, the spring 154 expands thus causing a return (anticlockwise) movement of the arms 88, 89 during which the clutches will free-wheel and no drive is imparted to the belts 82. Side guides 93, 94 are respecively slidably mounted on rods 95, 96, the latter being carried on the support brackets 80, 73 associated with the bars 62, 65. Also carried on each of the support brackets 80, 73 associated with the bars 62, 65 is a bar 97 (FIG. 5) the position of which is adjustable according to the required disposition of the stack 60 in the hopper 61 and also the size of the blanks constituting the stack. It will be seen that the positions of the support brackets 73, 80, side guides 93, 94 and bars 97 may be separately adjusted vertically and horizontally so as to enable carton blanks of different sizes and shapes to be placed in the hopper 61.

Extending across the machine, to the right (as viewed in FIG. 5) of the vertical bars 62, 65, is a drive shaft 98, which is driven continuously in a clockwise direction by any convenient means (not shown). Fixed at spaced positions along the shaft 98 are two feed drums 99, 100 and two support drums 101, 102. The drums 99, 100 are hollow and have respectively rims 103, 104, (FIG. 6) provided with groups of holes 105, 106.

Stationary suction chambers 107, 108, to which suction is applied, via pipes 109, 110, respectively, from any convenient source of suction (not shown) are positioned respectively behind the rims 103, 104, so that as the feed drums 99, 100 rotate, suction is applied through each successive group of holes 105, 106. No suction is applied to the drums 101, 102 which are solid, as shown in FIG. 6.

In operation the support brackets 73, 80, side guides 93, 94, and bars 97, are clamped in the positions shown in FIGS. 5, 7 and the feed drums 98, 100 and support drums 101, 102, are positioned on the drive shaft 98 so that when the stack 60 of blanks is placed in the hopper 61, as shown in FIGS. 5, 7, the feed drums 99, 100 respectively engage the leading flaps 11, 13, and the support drums 101, 102 respectively engage the leading flaps 12, 14 of the leading blank in the stack. The intermittent clockwise movement of the belts 82 urges the stack 60 to the right, as viewed in FIG. 5, so that the leading blank in the stack 60 is in contact with the drums 99 to 102. As the feed drums 99, 100 rotate, the leading blank in the stack is moved upwardly as a group of holes 105, 106 pass over the suction chambers 107, 108 and suction is applied to the blank. An adjustable gate 111 (FIG. 5) is provided above the stack 60, to ensure that only one blank is removed from the hopper 61 at a time.

As the feed drums continue to feed the blank away from the hopper 61, suction ceases to be applied through the groups of holes 105, 106 as the latter move clear of the suction chambers 107, 108. Just before this occurs the blank is gripped between the surface of the drums 99 to 102 and a series of narrow belts as will now be described. The panel 2 and leading flap 11 of the blank are gripped between the rim 103 of the drum 99 and an endless belt 112 (FIGS. 5, 6) which extends around rollers 113 to 116, the belt being driven by the roller 115 which is keyed to a drive shaft 117. The panel 4 and leading flap 13 are gripped between the rim 104 of the drum 100 and an endless belt 118 (FIG. 6) the belt 118 being mounted and driven in the same way as the belt 112. With this arrangement the panels 2, 4 and leading flaps 11, 13 are constrained to conform to the curvature of the drums 99, 100 over an arc which extends between the rollers 113 and 114.

The panel 3 and leading flap 12 are gripped between the peripheral surface of the drum 101 and an endless belt 119 (FIG. 5) which is so arranged that the panel 3 and leading flap 12 are constrained to follow the curvature of the drum 101 over an arc extending between a roller coaxial with the roller 113 and a roller 120. The panel 5, leading flap 14 and flap 21 are gripped between the surface of the drum 102 and an endless belt (not shown) which is identical to the belt 119, so that the panel 5, leading flap 14 and flap 21 are constrained to follow the curvature of the drum 102 over an arc corresponding to that between the rollers 113, 120 mentioned above.

Mounted above the support drum 101 is a finger 121 having a hooked end 122, the finger being freely mounted on a spindle 123 and normally resting against a stop 124, being held in this position by a torsion spring (not shown) carried on the spindle 123. A further finger 125 (FIG. 6) of identical construction to the finger 121, is mounted above the support drum 102.

As mentioned above with reference to the fingers 45, the fingers 121, 125 could, if desired, be offset to one side of the support drums 101, 102 respectively.

As the blank continues to be fed on the periphery of the drums 99 to 102, past the roller 120 the leading flap 12 is progressively released from the grip of the belt 119 and drum 101. As the flap 12 is now no longer constrained to conform to the curve of the drum 101, the leading edge of the flop will extend in a direction tangential to the periphery of the drum and thus lift relative to the leading flap 13. At the same time the leading flap 14 will lift in the same way.

On further movement of the blank the leading edges of the leading flaps 12, 14 engage the hooked ends of the fingers 121, 125 and the leading flaps 12, 14 and tabs 19, 20 are folded as described previously with reference to FIGS. 1 and 2, so this will not be described in detail again. Anti-clockwise movement of the finger 121 about the spindle 123 is limited by an adjustable stop 126, the finger 125 engaging a similar stop (not shown). The tabs 19, 20 are folded forwards (considered in the direction of movement of the blank) by fixed plough folders 127, 128 respectively with correspond to the folders 51 of FIGS. 1 and 2.

After the leading flaps 12, 14 and tabs 19, 20 have been folded, as described above, the blank is fed down an incline 129 formed by a number of slats 130, which are spaced apart across the machine as shown in FIG. 6. With the groups of holes 105, 106 spaced around the rims 103, 104 respectively, as shown in FIG. 5, and with the blanks being of the size and configuration shown in FIG. 7, the leading flap 14 of the blank will overlap the flap 21 of the preceding blank but, as mentioned previously, there will be no overlapping of other parts of the blank. Under these conditions as the blank emerges from beneath the belts 112, 118 and passes on to the slats 130, the now folded leading flaps 12, 14 and tabs 19, 20 are respectively engaged and held in the folded position by endless belts 131, (only one of which is visible in FIG. 5) mounted above extensions (not shown) of the slats 130, the belts 131 extending between rollers 132, 133 (FIG. 5). In an alternative arrangement the belts 131 may be replaced by fixed bars, or brushes. The blank is fed down the incline 129 by a pair of lugs 134, each lug being carried on a chain 135, which extends between sprockets 136, 137, the chains being driven continuously through a drive shaft 138 on which the sprockets are fixed. The chains 135 are positioned across the machine so that the lugs 134 engage the rear edge (considered in the direction of movement) of the blank, at the positions indicated in FIGS. 4 and 6. However, with blanks of a different size and shape to that shown, the position of the chains 135 across the machine may well be different, the blank being engaged by the lugs 134 at the most appropriate positions consistent with efficient conveying of the blanks down the incline 129.

It will be appreciated that as the flap 21 is covered by the leading flap of the next succeeding blank it is not possible to provide a lug to engage the rear edge of the flap 21. The blank is then fed by the lugs 134 into the nip of a pair of rollers 139, 140, which feed the blank to further apparatus of any convenient form, as mentioned above with reference to FIGS. 1 and 2. In the apparatus shown in FIG. 5 the belt 119 could, of course, be replaced by a fixed plate corresponding to the plate 24C mentioned above with reference to FIG. 3.

Depending on the length (i.e. the dimension extending in the direction of movement of the blanks through the machine) of the blanks being fed from the hopper 61 by the feed drums 99, 100, the pitch of the groups of holes 105, 106 may need to be altered. This may be achieved by blanking off some of the groups of holes so that only groups at the required putch areopen as they pass the suction chambers 107, 108. A number of ways of blanking off certain groups of holes 105, 106, is shown in FIGS. 8A to 8E and will now be described.

Figure 8A:
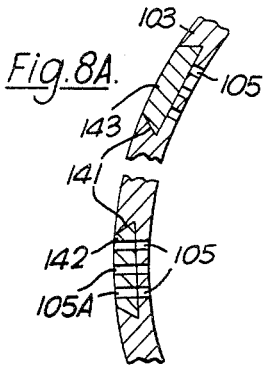

In FIG. 8A the rim 103 has slots 141 formed in it which coincide with the groups of holes 105 and interchangeable segments 142, 143 are provided, the segments 142 being provided with holes 105A and the segments 143 being solid. Thus, if suction is required to be applied through the holes 105, a segment 142 is inserted in the slot 141, and if no suction is required a segment 143 is inserted.

Figure 8B:
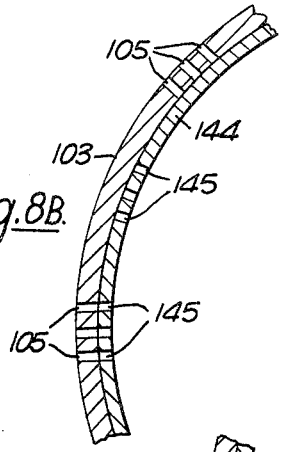
Figure 8C:
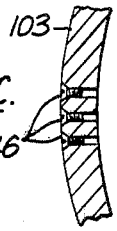

FIG. 8B shows a construction in which a slip ring 144 is mounted inside the rim 103 so that it is rotatable relative thereto. The ring 144 is provided with groups of holes 145, spaced at a different pitch to the groups of holes 105, so that by rotating the ring 144, the holes 145 may be moved into or out of communication with the holes 105. In FIG. 8C each hole in a group of holes 105, is blanked off by means of a countersunk screw 146.

Figure 8D:
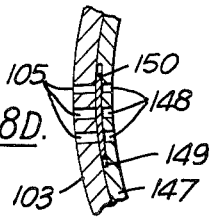

In FIG. 8D a ring 147 is fixed inside the rim 103 and is provided with holes 148 which coincide with the holes 105. A recess 149 is formed in the ring 147, as shown in the drawing and, if suction is not required to be applied through the holes 105, a solid plate 150 is inserted in the recess 149.

Figure 8E:
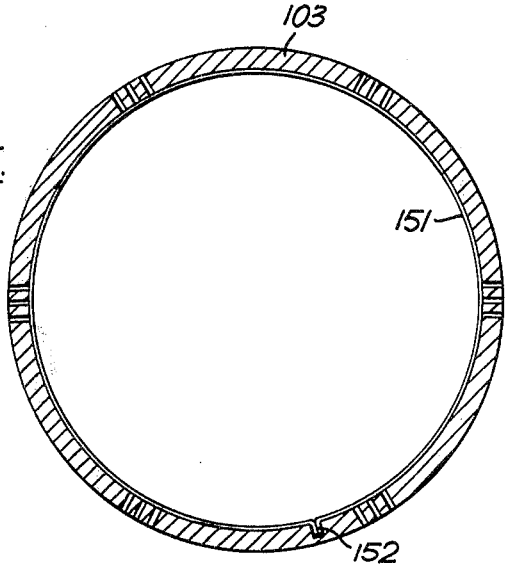

FIG. 8E shows a spring steel sleeve 151 fitted to the inside of the rim 103, the ends of the sleeve being located in a slot 152. A number of interchangeable sleeves 151 are provided, each having groups of holes formed therein which are so positioned that when a selected sleeve is placed inside the rim 103 suction is only applied to the required groups of holes 105.

It will be obvious that with changes in the pitch of the operative groups of holes 105, the pitch of the lugs 134 must also be changed and this is done by altering the number of lugs carried on each chain 135.

We claim:

1. A carton making machine including means for conveying a succession of carton blanks along a feed path, each blank comprising a body portion and a flap connected to said body portion at the leading end thereof, as considered in the direction of movement, along a crease line at right angles to said direction, and folding means to fold said flap about said crease line, wherein said feed path is of convex configuration, in the direction of movement of said blanks, along a section of its length, so that said flap projects tangentially to the curve of said convex section of said feed path, and said folding means is positioned adjacent said convex section of said feed path for engagement by said projecting flap so that said flap is folded by said folding means as said carton blank is fed along said convex section of said feed path by said conveying means.

2. A machine as claimed in claim 1 in which said conveying means includes a plurality of pairs of conveyor bands arranged side by side across the width of the machine, each pair comprising an upper and lower band, said upper band being positioned directly above said lower band so that said blanks are gripped between cooperating runs of each pair of conveyor bands, and at least one lower conveyor band having no upper band positioned thereabove, said one lower conveyor band being so positioned that it supports said flap and part of said body portion adjacent said flap, and means for diverting said cooperating runs of each of said plurality of pairs of conveyor bands and said one lower conveyor band out of the plane of said feed path to form said convex section of said feed path.

3. A machine as claimed in claim 2 in which an upper conveyor band is provided above said one lower band both upstream and downstream of said convex section of said feed path.

4. A machine as claimed in claim 3 in which said diverting means comprises a guide member consisting of a plurality of rotatable drums which are so positioned that the said one lower conveyor band and the cooperating runs of each of said pairs of conveyor bands pass round an arc of the peripheral surface of a different one of said drums.

5. A machine as claimed in claim 2 in which a fixed plate, having one edge thereof positioned adjacent said feed path, is provided above said one lower conveyor band upstream of said convex section of said feed path, said folding means being arranged to commence folding of said flap when said crease line lies along said one edge of said plate, and an upper conveyor band is provided above said one lower conveyor band downstream of said convex section of said feed path.

6. A machine as claimed in claim 5 in which said diverting means comprises a guide member consisting of a plurality of rotatable drums which are so positioned that the said one lower conveyor band the cooperating runs of each of said pairs of conveyor bands pass round an arc of the peripheral surface of a different one of said drums.

7. A machine as claimed in claim 1 in which said machine further includes a magazine in which carton blanks are stacked substantially horizontally with each blank supported on one of its edges, wherein said magazine includes feed means for said blanks consisting of at least one rotatable wheel, means to apply suction thereto, and at least one rotatable support member, and means to drive said feed means so that the blanks are removed in succession one at a time from said magazine, wherein a portion of the peripheral surface of said rotatable wheel together with a portion of the peripheral surface of said support member constitutes said convex section of said feed path.

8. A machine as claimed in claim 7 in which said conveying means includes a drive shaft extending across the width of the machine, a plurality of said rotatable wheels and said rotatable support members carried on said drive shaft at spaced intervals therealong, a plurality of conveyor bands which are so positioned that a different conveyor band is arranged to pass round an arc of the peripheral surface of each of said rotatable wheels and each of said rotatable support members so as to grip said blanks therebetween, wherein said conveyor bands which cooperate with said rotatable wheels extend over the whole length, as considered in the direction of movement, of said portion of said peripheral surface thereof, and said conveyor bands which cooperate with said rotatable support members extend over only the upstream part of said portion of said peripheral surface thereof.

9. A machine as claimed in claim 8 in which a plurality of fixed slats arranged side by side across the width of the machine, is provided downstream of said portions of said peripheral surfaces of said rotatable wheels and said rotatable support members, and an upper conveyor band is provided above each of said slats to feed said blanks away from the downstream end of said portions of the peripheral surfaces of said rotatable wheels and said rotatable support members.

10. A machine as claimed in claim 9 in which said folding means is positioned adjacent the downstream part of said portion of said peripheral surface of said rotatable support member.

11. A machine as claimed in claim 10 in which said rotatable wheel is hollow and is provided with a circumferential rim having spaced groups of holes formed therein, so that said groups of holes pass successively into communication with said suction means as said wheel is rotated, so that suction is applied to the leading blank in said magazine in order to remove it therefrom, wherein said rim is so adapted that selected ones of said groups of holes may be blanked off so that blanks are removed from said magazine by groups of holes other than said selected ones.

12. Apparatus for folding carton blanks having a body portion and a flap connected to the leading end thereof by a crease line comprising a. conveyor means arranged to contact top and bottom surfaces of a blank for conveying carton blanks along a straight feed path having a contiguous section of convex configurations, said conveyor means being arranged so as to lack a portion above the top surface of a blank so that a flap on a carton blank may pivot away from said convex section, b. folding means adjacent said convex section for folding a flap at the leading end of a carton blank about a crease line disposed at right angles to the direction of said path, said folding means being arranged to fold the flap in a rearward direction and away from the convex section of the feed path while the flap is moving along said convex section.

* * * * *